US010919735B2

(12) United States Patent
Plank et al.

(10) Patent No.: US 10,919,735 B2
(45) Date of Patent: Feb. 16, 2021

(54) LIFTING MECHANISM

(71) Applicant: Speed Shore Corporation, Houston, TX (US)

(72) Inventors: Michael J. Plank, Houston, TX (US); Robert Lolley, Houston, TX (US)

(73) Assignee: Speed Shore Corporation, Houston, TX (US)

( * ) Notice: Subject to any disclaimer, the term of this patent is extended or adjusted under 35 U.S.C. 154(b) by 0 days.

(21) Appl. No.: 16/353,663

(22) Filed: Mar. 14, 2019

(65) Prior Publication Data

US 2019/0284025 A1 Sep. 19, 2019

Related U.S. Application Data

(60) Provisional application No. 62/643,225, filed on Mar. 15, 2018.

(51) Int. Cl.
*B66C 1/42* (2006.01)
*B66C 1/38* (2006.01)

(52) U.S. Cl.
CPC ..... *B66C 1/422* (2013.01); *B66C 1/38* (2013.01)

(58) Field of Classification Search
CPC ..... B66C 1/422; B66C 1/38
USPC ..... 294/118, 215
See application file for complete search history.

(56) References Cited

U.S. PATENT DOCUMENTS 2,370,482 A * 2/1945 Weld ..... B66C 1/54 294/97
3,033,605 A * 5/1962 Morrow, Jr. ..... B66C 1/54 294/97
3,104,126 A * 9/1963 Lovash ..... B21C 47/30 294/97
3,211,490 A * 10/1965 Gardner ..... B66C 1/54 294/194
3,264,027 A * 8/1966 Luther ..... B65H 67/065 294/16
3,273,931 A * 9/1966 Caldwell ..... B66F 9/184 294/106
4,460,210 A * 7/1984 Miechur ..... B66C 1/54 294/97
6,257,636 B1 * 7/2001 Hovis ..... B66C 1/66 294/110.1
2003/0038493 A1 * 2/2003 Harris ..... B66C 1/54 294/97
2006/0202497 A1 * 9/2006 Cveykus ..... B66C 1/422 294/118
2013/0082477 A1 * 4/2013 Fuller ..... B66C 1/66 294/215

* cited by examiner

*Primary Examiner* — Stephen A Vu
(74) *Attorney, Agent, or Firm* — Tumey, L.L.P

(57) ABSTRACT

A lifting mechanism assembly comprising a lifting section, a compression section, and an attaching section.

20 Claims, 5 Drawing Sheets

LIFTING MECHANISM

CROSS-REFERENCE TO RELATED APPLICATIONS

This application claims priority to Provisional Application Ser. No. 62/643,225 filed Mar. 15, 2018.

BACKGROUND

Embodiments relate generally to tubular lifting equipment that may lift a targeted object. More particularly, embodiments relate to a lifting mechanism that moves tubular structures in a direction along the central axis of the tubular structure.

Tubular structure lifting equipment may be utilized for various pursuits, for example, without limitation, industries like construction, infrastructure, or for general handling of pipe and tubing. Currently there is a variety of apparatuses that may be in use to accomplish the task of transporting tubular structures. These devices may clamp around the tubular structure openings or enter within the opening and push out against the inner wall of the tubular structure. These apparatuses may produce unwanted stresses within the tubular structures and may pose a risk of slippage. There may be safety concerns when lifting and transporting tubular structures. Over time, fatigue may result in equipment failure. Thus, a new device for lifting tubular structures that may prevent slippage and/or reduce force produced in varying lifting devices (i.e., a horizontal pipe lifting clamp). A vertical lifting mechanism for lifting tubular structures will eliminate safety concerns and improve the lifetime of the subsequent components within the lifting mechanism.

BRIEF DESCRIPTION OF THE DRAWINGS

These drawings illustrate certain aspects of some of the embodiments of the present invention and should not be used to limit or define the invention.

DETAILED DESCRIPTION

Embodiments relate generally to a lifting mechanism for usage in tubular lifting and transportation. As discussed below, embodiments relate to a lifting mechanism that may be more effective for lifting tubular structures, in a vertical position, by doing so along the central axis of the tubular structure, wherein the central axis is parallel to the length of the tubular structure. In embodiments, the lifting mechanism may be constructed with multiple parts and connections that securely fasten the lifting mechanism about the end of a tubular structure. The lifting mechanism may be actuated to move a tubular structure along the central axis of the tubular, wherein the path of motion may be perpendicular to the cross-section of the tubular structure.

Figure 1:
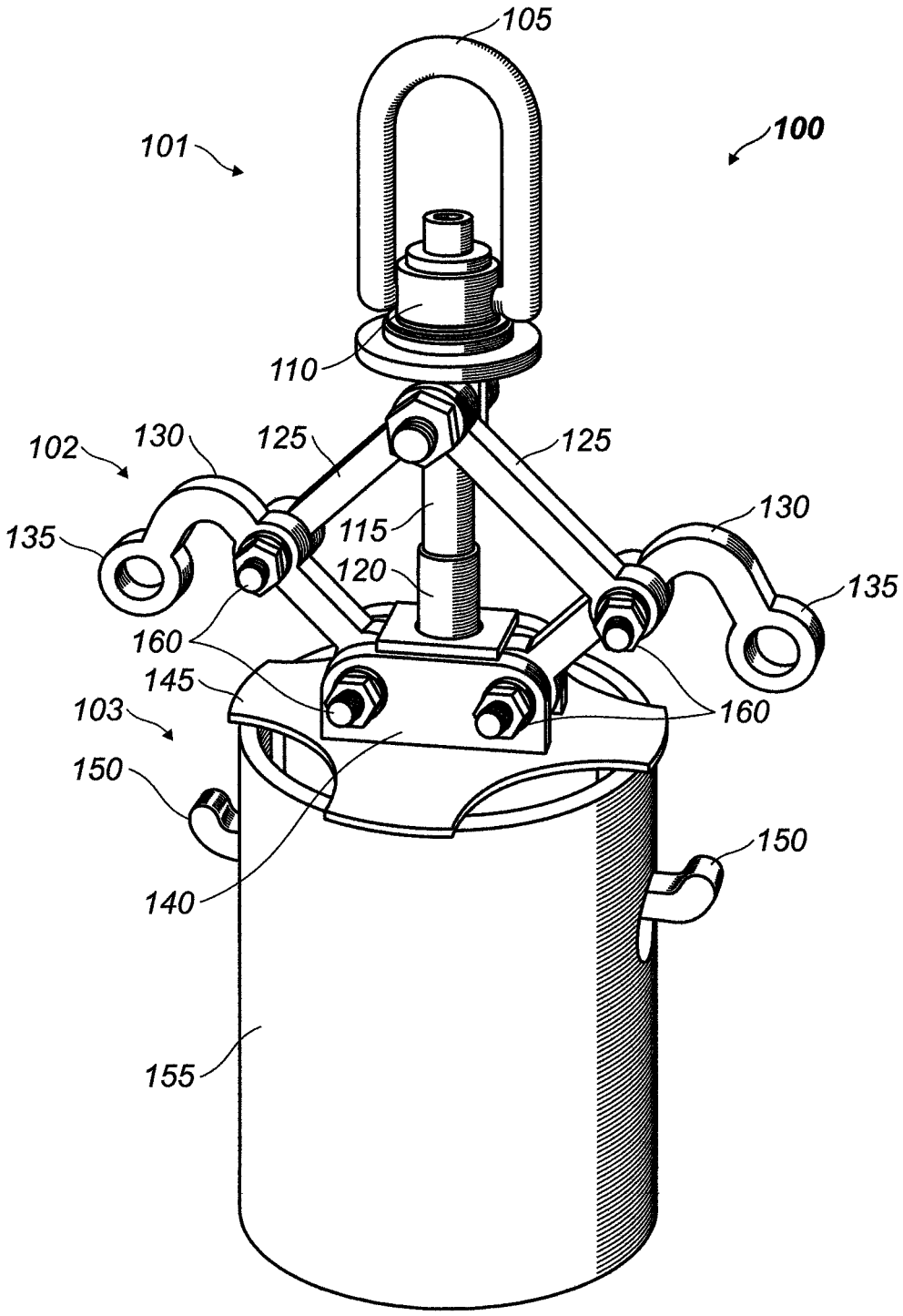
FIG. 1 illustrates a lifting mechanism assembly disposed in a tubular structure.

FIG. 1 illustrates a lifting mechanism assembly 100. Without limitation, lifting mechanism assembly 100, and any and/or all components of lifting mechanism assembly 100, may be made from any suitable material such as metal, nonmetal, plastic, alloy, composite, ceramic, or any combination thereof. Lifting mechanism assembly 100 may comprise of a lifting section 101, a compression section 102, and an attaching section 103. Lifting section 101 may allow for a secure connection between lifting mechanism assembly 100 and outside equipment. Compression section 102 may allow for movement between the individual components within lifting assembly 100. Attaching section 103 may function by securely fastening lifting mechanism assembly 100 onto a desired object. In embodiments, lifting section 101 may be disposed on one side of compression section 102, and attaching section 103 may be disposed on the opposite side of compression section 102.

Lifting section 101 may operate to allow the lifting mechanism 100 to attach to other equipment. Lifting section 101 may comprise of a link 105 and a link mount 110. Link 105 may have the capability of rotating along an axis. Link 105 may be any suitable size, height, or shape. Without limitation, link 105 may comprise any suitable material such as metal, plastic, an alloy, or any combination thereof. In embodiments, link 105 may comprise any suitable device such as hoist rings, snaps, S-hooks, shackles, and/or padeyes. Link 105 may be able to structurally support the lifting mechanism and any suitable loads thereon. In embodiments, link 105 may be disposed within link mount 110. Link mount 110 may securely hold part of link 105 in place. Link mount 110 may be any suitable size, height, or shape. Without limitation, link mount 110 may comprise any suitable material such as metal, plastic, an alloy, or any combination thereof. In combination with link mount 110, link 105 may rotate along multiple axes.

Lifting section 101 may be disposed on compression section 102. In embodiments, as lifting section 101 operates, compression section 102 may move in accordance with that movement. Compression section 102 may compress and expand along a plane of direction in order to move parts within lifting mechanism assembly 100. Compression section 102 may comprise of a stem 115, a stem housing 120, one or more extensions 125, one or more arms 130, one or more attachments 135, and one or more connections 160. Link mount 110 may be disposed onto stem 115. Stem 115 may serve as the free-to-move part within lifting mechanism assembly 100. Stem 115 may be any suitable size, height, or shape. Without limitation, stem 115 may comprise any suitable material such as metal, plastic, an alloy, or any combination thereof. In embodiments, stem 115 may comprise an open and closed end on opposing sides. In embodiments, stem 115 may be disposed within stem housing 120. In embodiments, stem housing 120 may comprise an open and closed end. As illustrated in FIG. 1, the open end of stem 115 may be disposed in the open end of stem housing 120. This may allow stem 115 to traverse the length of stem housing 120. Stem housing 120 may be any suitable size, height, or shape. Without limitation, stem housing 120 may comprise any suitable material such as metal, plastic, an alloy, or any combination thereof.

Figure 2:
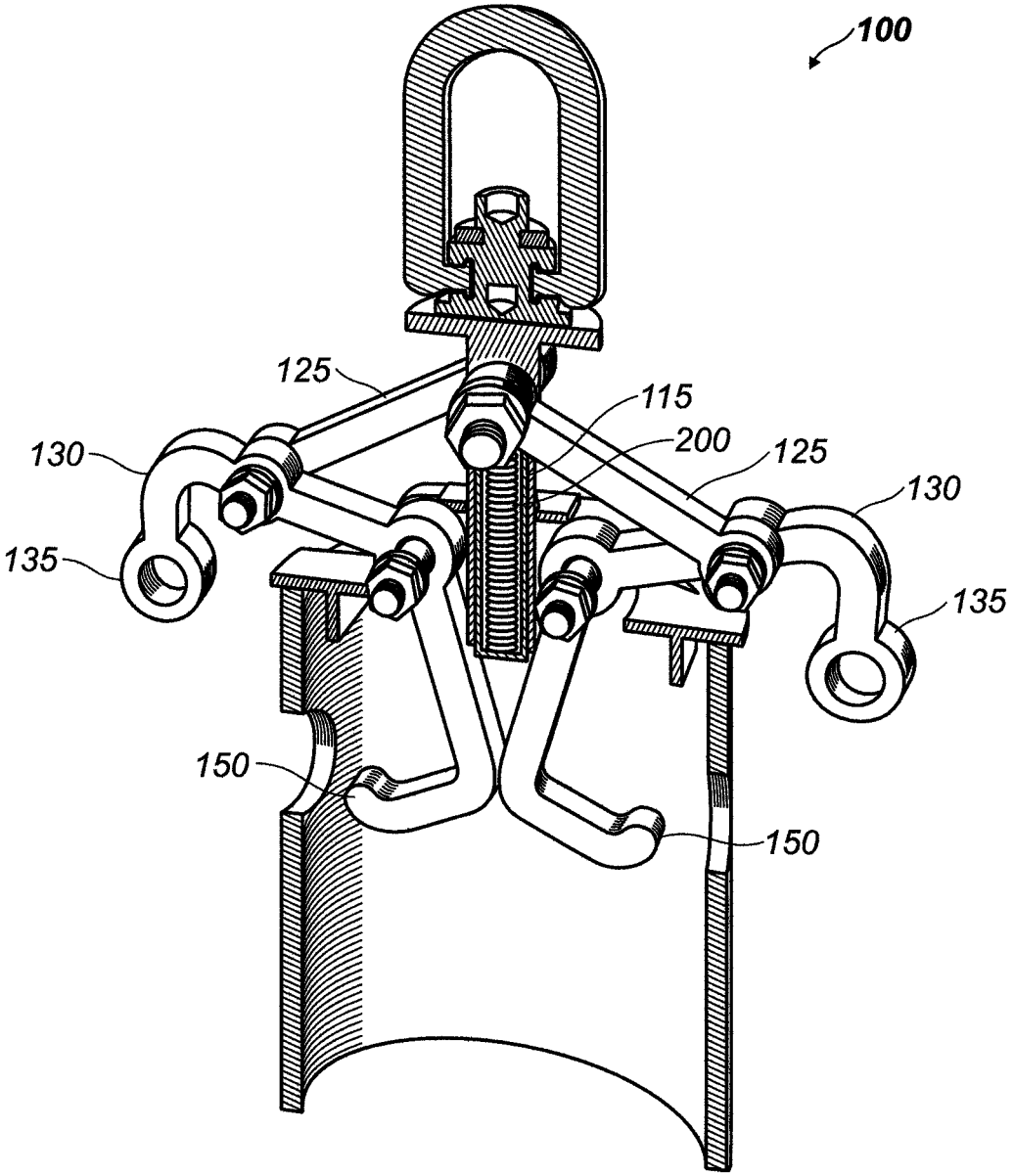
FIG. 2 illustrates the lifting mechanism assembly in a compressed state disposed in the tubular structure.

As illustrated in FIG. 2, an actuator 200 may facilitate the movement within compression section 102. In embodiments, actuator 200 may be disposed within stem 115 and stem housing 120 (referring to FIG. 1). Actuator 200 may move forward and backward along a line of motion. Actuator 200 may exert force against the closed end of stem 115 and the closed end of stem housing 120. In embodiments, actuator 200 may be a spring, hydraulic assembly, and/or the like. Actuator 200 may be any suitable size, height, or shape.

Without limitation, actuator 200 may be any suitable material such as metal, plastic, an alloy, or any combination thereof. Actuator 200 may comprise of a power source (not illustrated) that may supply energy to produce a force to enable motion within lifting mechanism assembly 100. The power source may be disposed at any suitable location within lifting mechanism assembly 100.

Referring back to FIG. 1, in embodiments, extensions 125 may be disposed on one end to stem 115. Extensions 125 may be disposed on the opposite end to arms 130. Extensions 125 may be any suitable size, height, or shape and be comprised of any suitable material such as metal, plastic, an alloy, or any combination thereof. Arms 130 may be any suitable size, height, or shape and be comprised of any suitable material such as metal, plastic, an alloy, or any combination thereof. Connection 160 may serve as a pivot point allowing the aforementioned disposed members to rotate if necessary. Without limitation, connection 160 may comprise of nuts and bolts, screws, rivets, washers, general fasteners, or any combination thereof.

In embodiments, attachments 135 may be disposed on one end of arm 130. Attachments 135 may be within lifting mechanism assembly 100 to serve as a connection point for other equipment. Attachments 135 may be any suitable size, height, or shape. Connecting material (not shown) may attach to attachments 135. Without limitation, connecting material may be rope, polymer fibers, metal links, or any combination thereof. Connecting material may serve to apply a force to the system in order to engage actuator 200 (referring to FIG. 2) into motion.

In embodiments, components within compression section 102 may move. Motion caused by the components may engage components within attaching section 103 causing the components within the attaching section 103 to move. Attaching section 103 may provide a securing function onto a targeted object. Attaching section 103 may comprise of an arm housing 140, a base plate 145, and one or more legs 150. In embodiments, legs 150 may be disposed on the opposite end of arms 130 from attachments 135. Legs 150 may provide the securing function onto the object that lifting mechanism assembly 100 may require. Referring to FIG. 1, legs 150 may pass through the cross-sectional area of a tubular structure 155 and may be secured to tubular structure 155 through openings. In other embodiments, there may be a plurality of legs 150 for a better force distribution. Legs 150 may be any suitable size, height, or shape. Without limitation, legs 150 may comprise any suitable material such as metal, plastic, an alloy, or any combination thereof.

Between the disposed location of extension 125 with arm 130 and the location of leg 150, there may be arm housing 140. As illustrated in FIGS. 1 and 2, arms 130 may be disposed to arm housing 140 by connection 160. Arm housing 140 may serve as a point of rotation for arms 130. Arm housing 140 may be any suitable size, height, or shape. Without limitation, arm housing 140 may comprise any suitable material such as metal, plastic, an alloy, or any combination thereof.

Base plate 145 may be disposed below arm housing 140. Base plate may prevent lifting mechanism assembly 100 from further entering the tubular structure 155. Base plate 145 may be any suitable size, height, or shape. Without limitation, base plate 145 may comprise any suitable material such as metal, plastic, an alloy, or any combination thereof.

Figure 3:
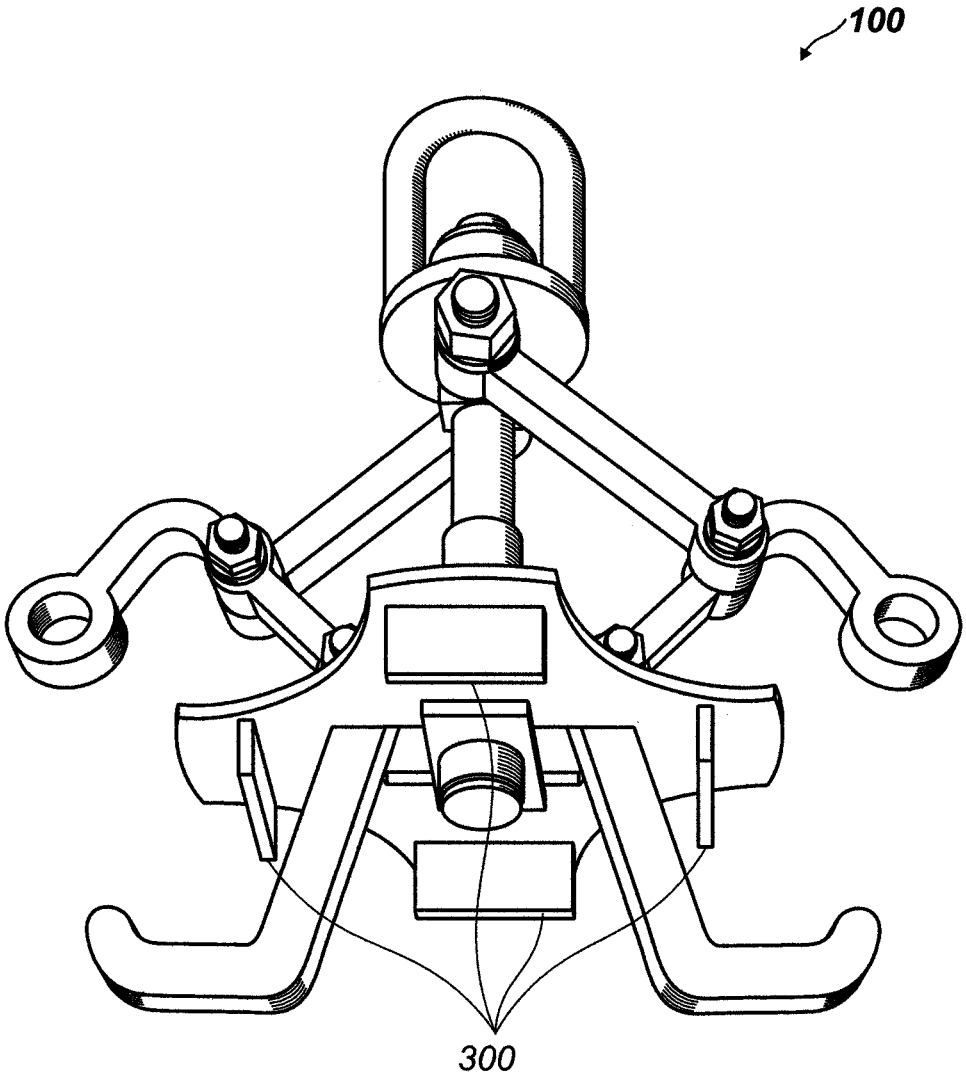
FIG. 3 illustrates a bottom view of the lifting mechanism assembly.

As illustrated in FIG. 3, one or more plates 300 may be disposed on the bottom of base plate 145 (referring to FIG. 1). In embodiments, there may be a plurality of plates 300. Plurality of plates 300 may serve lifting mechanism assembly 100 for stability when in operation. Plates 300 may prevent lifting mechanism assembly 100 from translating along multiple axes while engaging tubular structure 155. Plate 300 may be any suitable size, height, or shape. Without limitation, plate 300 may comprise any suitable material such as metal, plastic, an alloy, or any combination thereof.

Figure 4:
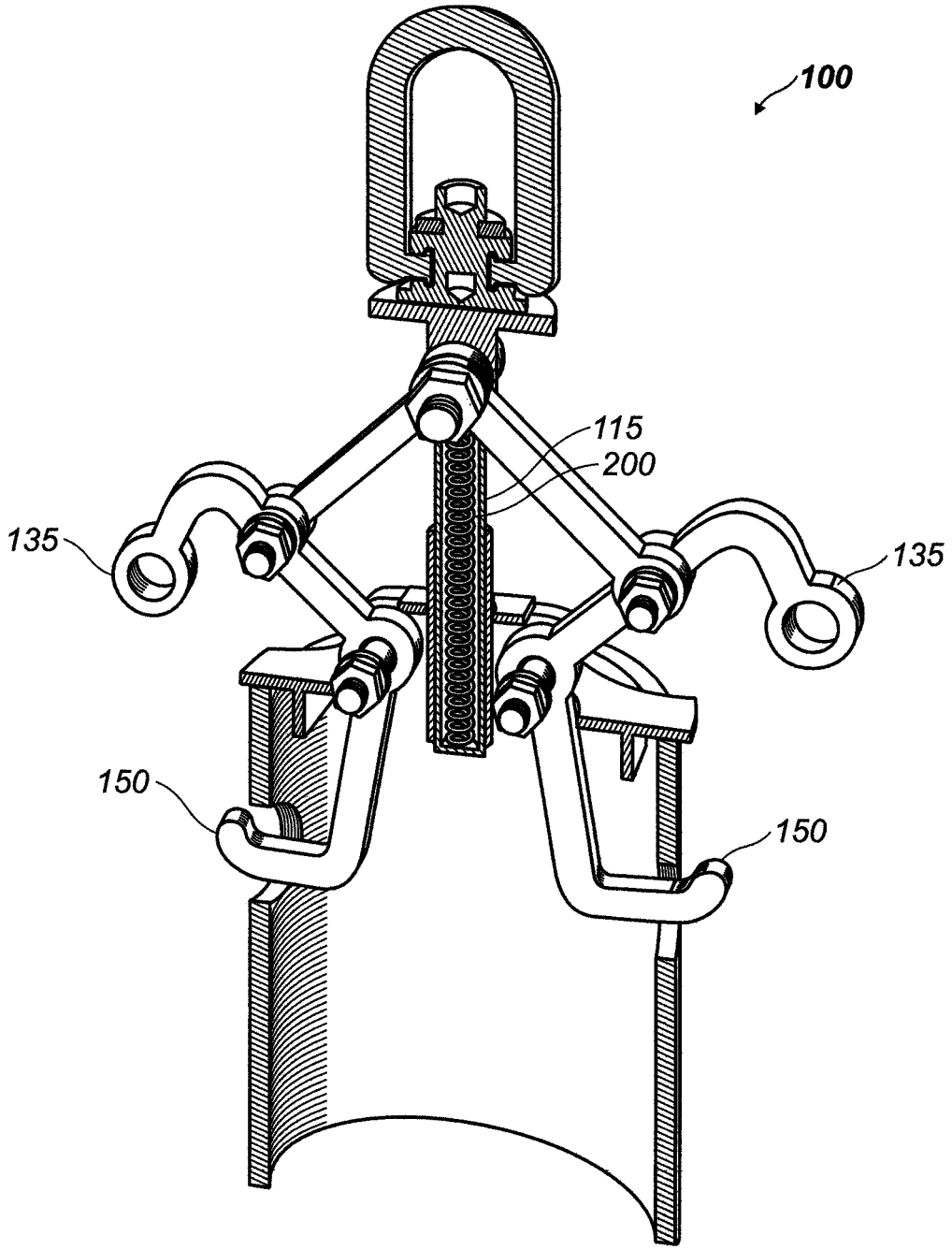
FIG. 4 illustrates the lifting mechanism assembly in a relaxed state disposed in the tubular structure.

Lifting mechanism assembly 100 may operate in a dynamic fashion. FIGS. 2 and 4 may represent the static end points of its line of motion. As illustrated in FIG. 2, actuator 200 is in the compressed state. Applying a force to attachments 135, arms 130 and extensions 125 may force actuator 200 to move. This force may cause the entirety of lifting mechanism assembly 100 to compress, as shown in FIG. 2. This motion may flare arms 130 outwards in relation to stem 115 and retract legs 150 from their original position. Without a force being applied to attachments 135, actuator 200 may be in the relaxed state with legs 150 flared out in a horizontal direction in relation to stem 115, as illustrated in FIG. 4.

Lifting mechanism assembly 100 may be actuated by some force upon attachments 135 in order to be inserted into a tubular structure 155. Once inserted, the force may be released in order for legs 150 to secure to tubular structure 155. The force may be actuated by an operator, through an automated system, or any combination thereof. Once tubular structure 155 has been transported, lifting mechanism assembly 100 may be removed by actuating some force onto attachment 135 and pulling lifting mechanism assembly 100 out of tubular structure 155.

Figure 5:
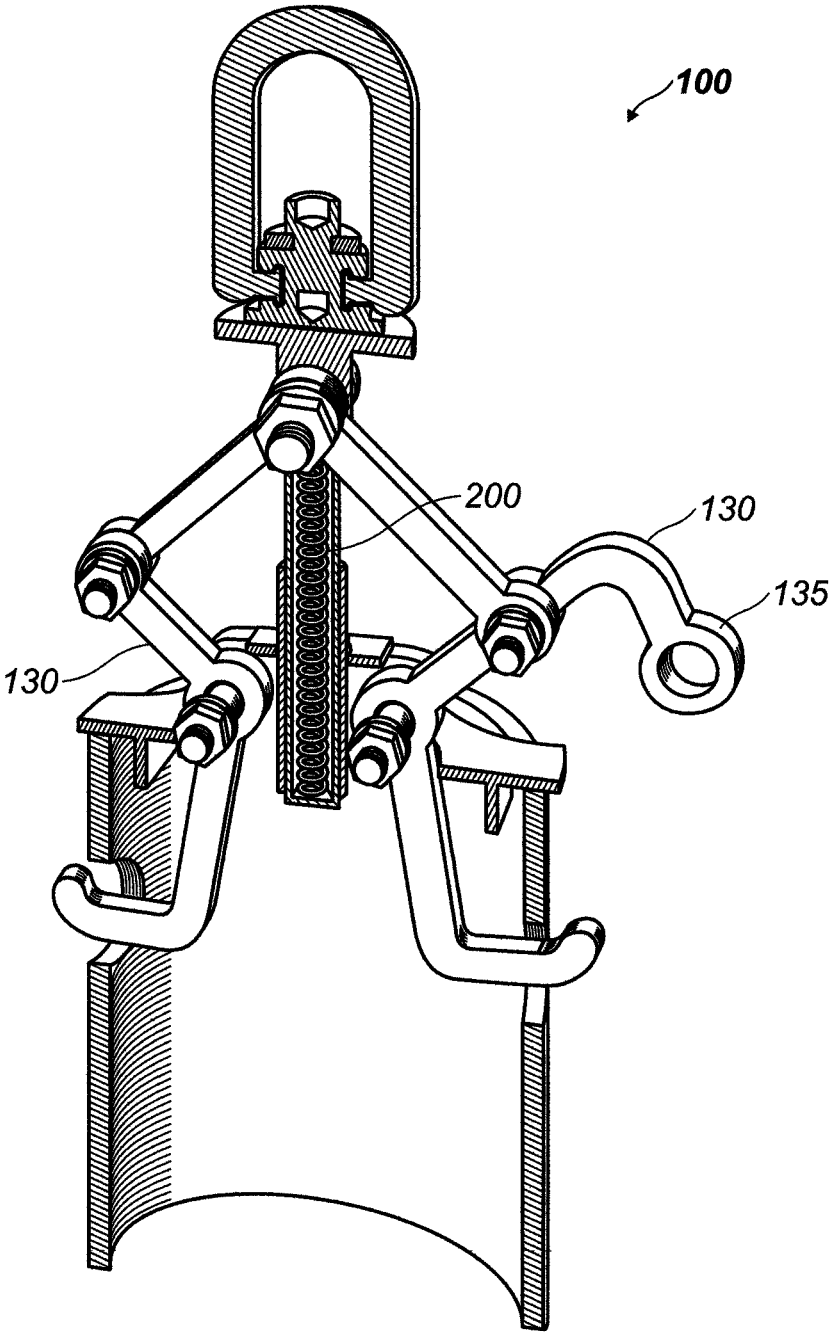
FIG. 5 illustrates another embodiment of the lifting mechanism.

In other embodiments, there may be more or less parts within lifting mechanism assembly 100 to help with stability and force distribution. There may be one or two more arms 130, legs 150, and subsequent parts that are disposed upon those. As illustrated in FIG. 5, one of attachments 135 is not disposed to an arm 130. There may be a singular or plurality of attachments 135 required to actuate actuator 200 in order to move lifting mechanism assembly 100.

The foregoing figures and discussion are not intended to include all features of the present techniques to accommodate a buyer or seller, or to describe the system, nor is such figures and discussion limiting but exemplary and in the spirit of the present techniques.

What is claimed is:

1. A lifting mechanism assembly, comprising:

a lifting section;

a compression section;

an attaching section, wherein the attaching section comprises one or more legs capable of passing through a cross-sectional area of a tubular by flaring out in a horizontal direction, wherein the one or more legs are secured to the tubular through openings in opposing sides of the tubular; and a base plate, wherein the base plate prevents the lifting mechanism assembly from fully entering the tubular.

2. The lifting mechanism assembly of claim 1, wherein the lifting section is disposed on a first side of the compression section and the attaching section is disposed on an opposite second side of the compression section.

3. The lifting mechanism assembly of claim 1, wherein the lifting section comprises a link and a link mount.

4. The lifting mechanism assembly of claim 3, wherein the link comprises a hoist ring.

5. The lifting mechanism assembly of claim 3, wherein the link is rotatable along multiple axes when combined with the link mount.

6. The lifting mechanism assembly of claim 1, wherein the compression section comprises an attachment.

7. A lifting mechanism assembly, comprising:

a lifting section;

a compression section;

an attaching section; and a base plate, wherein the base plate prevents the lifting mechanism assembly from fully entering a tubular, and further wherein the base plate comprises a plurality of plates disposed on a bottom side of the base plate.

8. The lifting mechanism assembly of claim 7, wherein the attaching section comprises an arm housing and one or more legs.

9. A lifting mechanism assembly, comprising:

a lifting section;

a compression section, wherein the compression section comprises an attachment, wherein the attachment is capable of attaching to a connecting material;

an attaching section; and a base plate, wherein the base plate prevents the lifting mechanism assembly from fully entering a tubular, and further wherein the base plate comprises a plurality of plates disposed on a bottom side of the base plate.

10. The lifting mechanism assembly of claim 9, wherein the compression section further comprises a stem and a stem housing.

11. The lifting mechanism assembly of claim 10, wherein the stem comprises an open end and a closed end.

12. The lifting mechanism assembly of claim 10, wherein the stem housing comprises an open end and a closed end.

13. The lifting mechanism assembly of claim 10, wherein the stem is disposed within the stem housing.

14. The lifting mechanism assembly of claim 9, wherein the compression section further comprises an arm and an arm housing.

15. The lifting mechanism assembly of claim 14, wherein the arm and the arm housing are attached to each other by a connection.

16. The lifting mechanism assembly of claim 15, wherein the connection comprises a nut and a bolt.

17. The lifting mechanism assembly of claim 9, wherein the compression section further comprises an extension.

18. The lifting mechanism assembly of claim 9, wherein the compression section further comprises an actuator.

19. The lifting mechanism assembly of claim 18, wherein the actuator comprises a spring.

20. The lifting mechanism assembly of claim 18, wherein the actuator is activated via a power source.

* * * * *